US006332228B1

(12) United States Patent
Takahara

(10) Patent No.: US 6,332,228 B1
(45) Date of Patent: Dec. 25, 2001

(54) HELMET COVER AND HELMET

(75) Inventor: Tomohiko Takahara, Higashi-Osaka (JP)

(73) Assignee: O.G.K. Hanbai Co., Ltd., Osaka (JP)

( * ) Notice: Subject to any disclaimer, the term of this patent is extended or adjusted under 35 U.S.C. 154(b) by 0 days.

(21) Appl. No.: 09/235,547

(22) Filed: Jan. 22, 1999

(30) Foreign Application Priority Data

Jan. 22, 1998 (JP) ..... 10-010458

(51) Int. Cl.[7] ..... A42B 3/00
(52) U.S. Cl. ..... 2/422; 2/425
(58) Field of Search ..... 2/410, 411, 412, 2/422, 424, 425, 184.5

(56) References Cited

U.S. PATENT DOCUMENTS

| | | | | |
|---|---|---|---|---|
| 4,599,752 | * | 7/1986 | Mitchell | 2/425 |
| 4,993,082 | * | 2/1991 | Gentes et al. | 2/410 |
| 4,995,117 | | 2/1991 | Mirage . | |
| 5,123,121 | * | 6/1992 | Broersma | 2/421 |
| 5,581,819 | * | 12/1996 | Garneau | 2/421 |
| 5,619,756 | * | 4/1997 | Garneau | 2/425 |
| 5,940,889 | * | 8/1999 | Shirai | 2/411 |

FOREIGN PATENT DOCUMENTS

| | | |
|---|---|---|
| 0217996A | 4/1987 | (EP) . |
| 0619955A | 10/1994 | (EP) . |
| 1456824A | 11/1976 | (GB) . |
| 2219728A | 12/1989 | (GB) . |
| 5833624 | 3/1984 | (JP) . |
| 3037891 | 3/1997 | (JP) . |
| WO9748298A | 12/1997 | (WO) . |

* cited by examiner

*Primary Examiner*—Michael A. Neas

(57) ABSTRACT

A helmet cover for use with a helmet having through-holes extending thicknesswise through the helmet at predetermined positions, the helmet cover comprising a configuration to be fitted over the helmet, and a portion for closing the through-holes in the fitting region, the helmet cover being formed of a resin material.

8 Claims, 6 Drawing Sheets

HELMET COVER AND HELMET

BACKGROUND OF THE INVENTION

1. Field of the Invention

The present invention relates to a helmet cover for use with a helmet having through-holes and to a helmet provided with such helmet cover.

2. Description of the Prior Art

Of helmets for bicyclists or for use in other activities, there are helmets of the type having a plurality of through-holes extending thicknesswise within such a range as to ensure a predetermined strength. One major object of the provision of such through-holes is to lighten the weight of the helmet. Recently, it has been a tendency to enlarge each through-hole or increase the number of through-holes. The provision of such through-holes is also advantageous in improving the ventilation of the helmet.

Particularly in winter the helmet user frequently feels cold at the head due to air flow entering the helmet through the through-holes. Further, when it rains in any season, rain water entering the helmet through the through-holes wets the head of the user and hence makes the user feel uncomfortable. Thus, a helmet with protection against cold and rain is being desired.

SUMMARY OF THE INVENTION

In view of the above, it is a first object of the present invention to provide a helmet cover which is capable of easily and rapidly providing a helmet having through-holes with protection against cold and rain.

It is a second object of the present invention to provide a helmet having such helmet cover.

It is a third object of the present invention to provide a helmet cover which enables the helmet to resume its original state easily and rapidly when the protection against cold and rain becomes unnecessary.

It is a fourth object of the present invention to provide a helmet cover which does not become a substantial hindrance in lightening the whole weight of the helmet, reducing the air resistance of the helmet, and the like when the helmet is under the protected condition against cold and rain by the helmet cover.

It is a fifth object of the present invention to provide a helmet cover which is hardly deformable when it provides the helmet with protection against cold and rain.

It is a sixth object of the present invention to provide a helmet cover which does not become a substantial hindrance in the appearance, particularly painting and number display, of the helmet when the helmet is under protection against cold and rain by the helmet cover.

It is a seventh object of the present invention to provide a helmet cover which is capable of modifying the design of the helmet as a whole as well as providing protection against cold and rain.

Thus, according to the present invention there is provided a helmet cover having a configuration to be fitted over a helmet when the helmet cover is fitted thereon.

With this feature, when the helmet cover is fitted on the helmet, through-holes extending thicknesswise through the helmet located in the fitting region are closed with the helmet cover.

The helmet cover may be formed of an appropriate resin material. If a vacuum forming process is employed, the resulting helmet cover has a thickness of 1 mm or less. Such a highly thin helmet cover will not add a substantial weight to the weight of the helmet or a substantial air resistance to the air resistance that is inherent to the helmet.

To fit the helmet cover on the helmet and maintain the fitting condition, it is conceivable to use a dual-faced adhesive tape or the like. However, it is more advantageous to form a plurality of wind splitting recesses each defining a through-hole at the bottom thereof in the helmet and form in the cover a plurality of corresponding wind splitting recesses each shaped to match each corresponding recess of the helmet and close the through-hole defined by the recess.

With this structure it is possible to fit the helmet cover on the helmet and remove it therefrom easily and rapidly and, at the same time, the cover prevents its own deformation by virtue of the rib effect developed by each wind splitting recess. Moreover, fitting and removal of the cover can be repeated as required. In other words, repeated use of the cover is possible.

The wind splitting recess formed in the cover may each be formed with an inwardly protruding portion adapted to protrude into the corresponding through-hole of the helmet. When the through-holes of the helmet are closed by fitting each inwardly protruding portion into the corresponding through-hole, the fitting condition of the cover on the helmet can be reliably maintained, while at the same time the cover can be fitted on and removed from the helmet with ease. If such a inwardly protruding portion is formed at least in front and opposite side portions of the cover, the longitudinal and transverse positioning of the cover on the helmet can be made easily by merely closing the through-holes with the corresponding protruding portions thereby preventing the cover from coming off undesirably due to air pressure or the like.

If the cover is formed of a transparent resin material, the cover does not shade the painting and the like of the helmet and, hence, the helmet with the cover presents substantially the same appearance as without the cover. Further, the cover provides another advantage of protecting the painting of the helmet. Thus, it is possible to use the cover for this purpose only.

Unlike the transparent cover mentioned above, if the cover is differently painted than the helmet, it offers such advantages as to allow the user or other persons to obviously perceive the cover on the helmet and to easily modify the design of the helmet as a whole.

The cover may be configured to be fitted over only a top region or other region of the helmet. If the cover is configured to be fitted over only a portion of the helmet, through-holes in the regions (for example, opposite side regions or a rear region) which are not covered are left open to secure the ventilation of the helmet.

If a wind splitting recess is formed in a rear portion of the cover and a corresponding recess is formed in a rear portion of the helmet, the cover can be closely fitted on the helmet by engaging first the rear recess of the cover with the corresponding recess of the helmet, force-fitting other portion of the cover over the helmet with the rear recess used as a reference point and completing the positioning at recesses located in the front and opposite side portions. In this way the cover provides protection against cold and rain, while the helmet even fitted with the cover maintains its wind splitting effect.

The helmet cover of the present invention may, before fitted on the helmet, be of a configuration such as to facilitate the covering over the helmet (for example, a hollow hemisphere of a size larger than the helmet, or a pouch or sheet formed of a soft plastic). With such configuration, the cover after having covered the helmet can be deformed by a heat treatment so as to be conformably fitted over the helmet in a face contact fashion. Thus, it is possible to provide an enhanced close fitting property with respect to various types of helmets.

These and other objects, features and attendant advantages of the present invention will be more fully appreciated from the following detailed description to be read in conjunction with the accompanying drawings.

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will now be described in detail with reference to the drawings.

Figure 1:
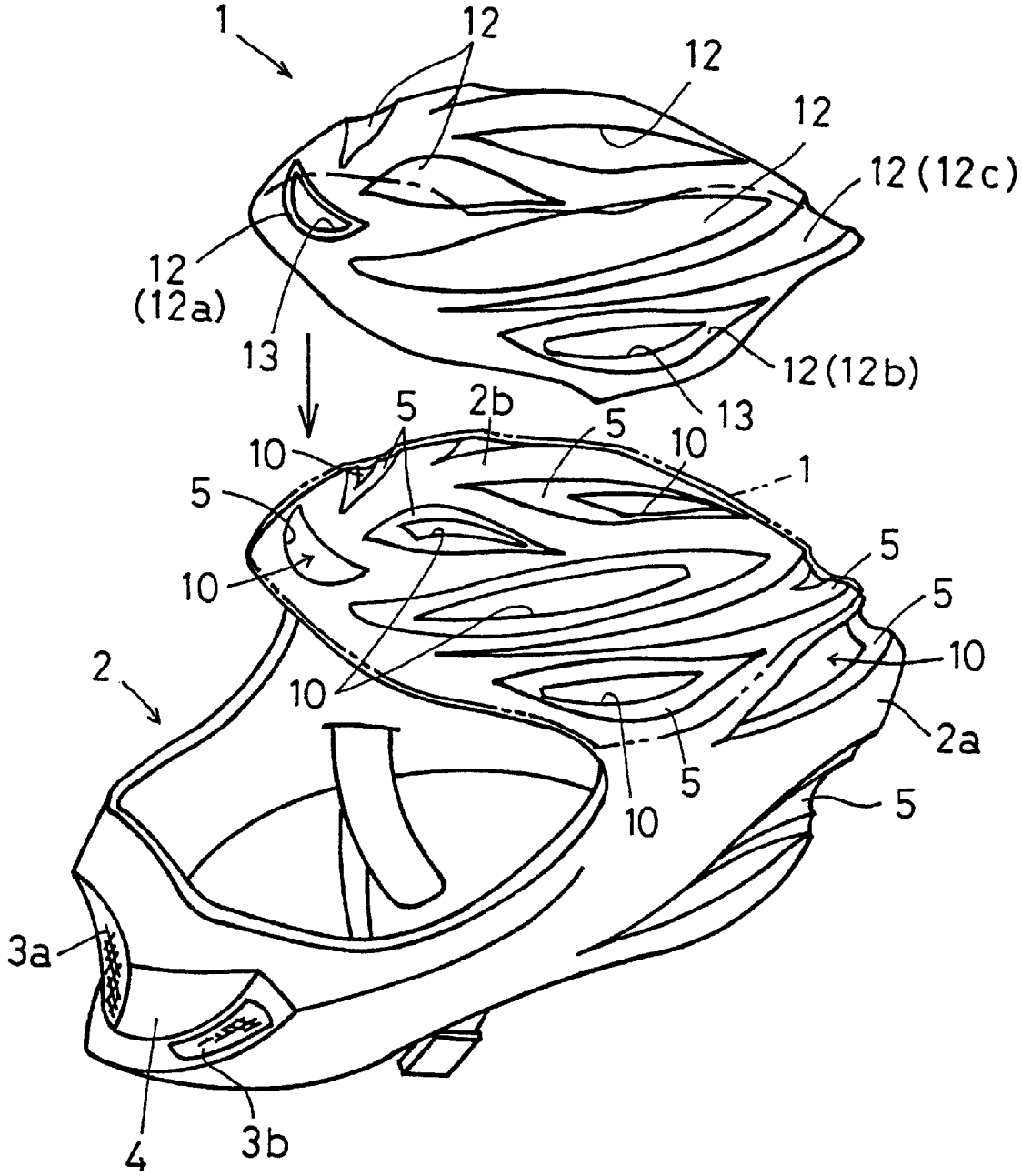
FIG. 1 is a perspective view showing one embodiment of a helmet cover according to the present invention.
Figure 2:
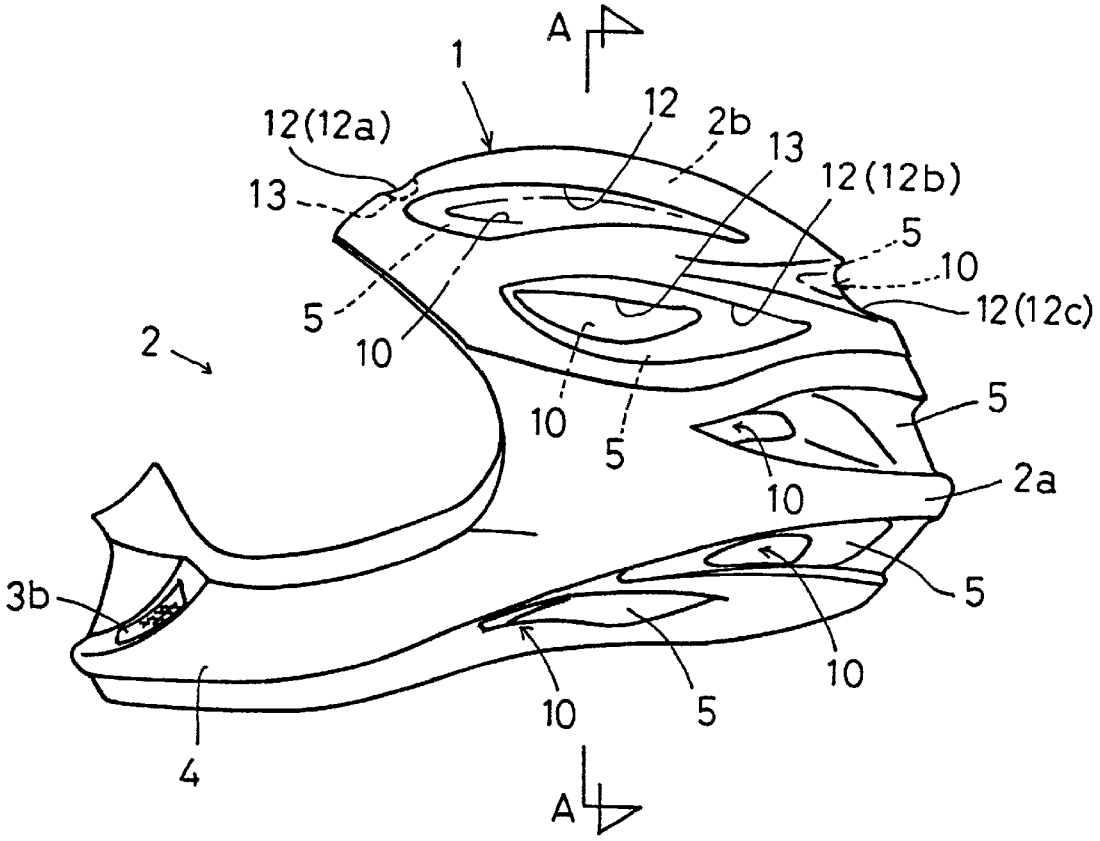
FIG. 2 is a side elevational view showing the helmet cover of FIG. 1 as fitted on a helmet.
Figure 3:
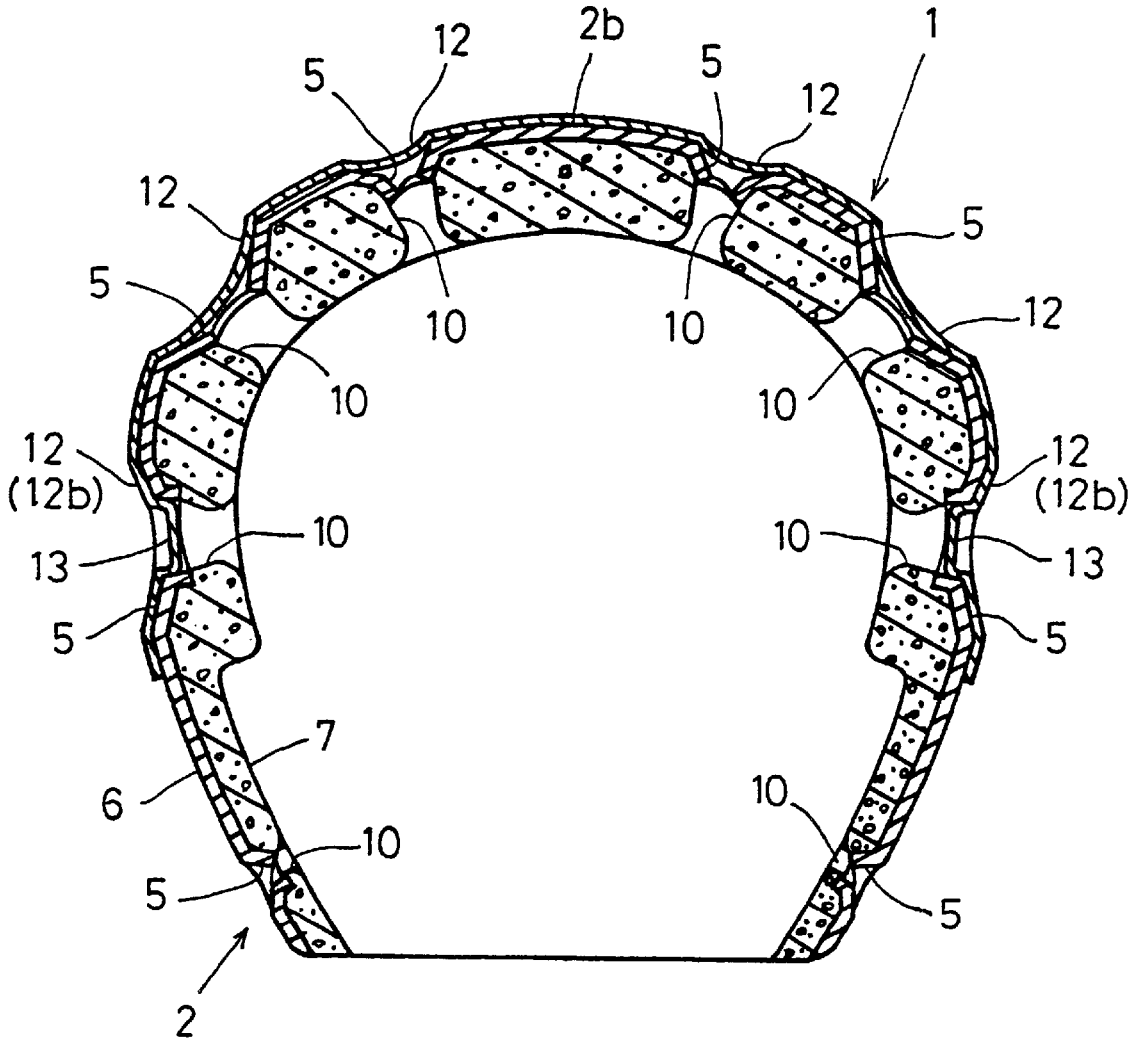
FIG. 3 is an enlarged sectional view taken on line A—A in FIG. 2.

FIGS. 1 to 3 illustrate one embodiment of a helmet cover 1 according to the present invention for use with a helmet 2. The helmet 2 shown is adapted for bicyclists and is of the full-face type which is formed integrally with a jaw guard portion 4 on the front side thereof, the jaw guard portion 4 having air inlets 3*a* and 3*b*. The helmet 2 has a wind control region 2*a* on the rear side thereof which protrudes relatively long rearwardly for setting an air departing point at a rearer position.

The helmet 2 defines a plurality of wind splitting recesses 5 of a streamlined or waved shape in an area extending from a top region 2*b* to the wind control region 2*a* so as to stabilize the air flow on the helmet 2 and then cause it depart from the helmet 2. Most of the wind splitting recesses 5 each define at the bottom thereof a through-hole 10 extending thicknesswise through a helmet body 6 and liner 7 (refer to FIG. 3) for ensuring ventilation of the helmet.

The helmet cover 1 is adapted to be fitted over the top region 2*b* of the helmet 2. The cover 1 is formed of an appropriate resin material and has a thickness of 1 mm or less. Examples of such resin materials include vinyl chloride resins, acrylic resins, acetate resins, polycarbonate, polyethylene terephthalate (PET) and acrylonitrile-butadiene-styrene (ABS), without any limitation.

According to this embodiment, a transparent vinyl chloride resin is molded into a predetermined shape by means of a vacuum forming process so as to obtain a cover having a thickness of 0.5 mm. This reduces the weight of the cover 1 to about 50 g, so that the cover 1 does not add a substantial increase to the weight of the helmet 2 when fitted thereon.

The cover 1 is shaped like a half of a rugby ball for covering only the top region 2*b* of the helmet 2. The cover 1 is formed with inwardly bulging wind splitting recesses 12 corresponding to the wind splitting recesses 5 located in the helmet top region 2*b* so that the recesses 12 can be fitted into the corresponding recesses 5. The provision of the wind splitting recesses 12 in the cover 1 not only ensures the wind splitting effect when the cover 1 is fitted on the helmet 2, but also prevents any deformation of the cover 1 or the like by virtue of a rib effect developed by the recesses 12, thereby allowing repeated use of the cover 1.

Therefore, the cover 1 is fitted on the helmet 2 in a face contact fashion at almost entire outer surface of the top region 2*b* including the inner surfaces of the wind splitting recesses 5.

Since all the wind splitting recesses 12 of the cover 1 are completely closed, the corresponding through-holes 10 of the helmet 2 are closed by the cover 1, thereby preventing entry of air, rain, and the like therethrough.

The wind splitting recesses 12 of the cover 1 includes a recess 12*a* in a front portion of the cover 1 and two recesses 12*b* in opposite side portions of the cover 1, each of the recesses 12*a* and 12*b* being formed with an inwardly protruding portion 13 which protrudes further inwardly of the cover 1.

The inwardly protruding portions 13 are each configured to be conformably fitted into the through-hole 10 of each corresponding wind splitting recess 5, so that longitudinal and transverse positioning of the cover 1 on the helmet 2 can be ensured at the front and opposite sides thereof.

Such a thin cover 1 made of a resin material as mentioned above has flexibility and elasticity as a whole. Accordingly, the cover 1 can be temporarily expanded so as to extend the distances between two recesses of the recess 12*a* in the front portion and the recesses 12*b* in the opposite side portions in fitting the cover 1 on the helmet 2.

Once the cover 1 is fitted on the helmet 2, the cover 1 naturally resumes its original form, i.e., the recesses 2*a* and 2*b* return into their original positions, so that the fitting condition of the cover 1 on the helmet 2 is maintained.

Since the cover 1 is fitted on the helmet 2 by fitting the inwardly protruding portions 13 of predetermined recesses 12 into the corresponding through-holes 10, the cover 1 as fitted on the helmet 2 is prevented from displacing or shifting longitudinally and transversely.

According to this embodiment, a recess 12*c* positioned in a rear portion of the cover 1 is shaped to be vertically engageable with a corresponding wind splitting recess 5 located in a rear portion of the helmet 2 because the recess 5 in the rear portion of the helmet 2 is a step-like configuration projecting rearward.

The recess 12*c* further prevents the longitudinal and transverse displacement or shift of the cover 1 on the helmet 2. This enables the cover 1 to be closely fitted on the helmet 2 and, hence, prevents any displacement of the cover 1 on the helmet 2 due to a strong wind or the like.

Specifically, the cover 1 is fixedly fitted on the helmet 2 by the steps of: engaging the recess 12*c* in the rear portion of the cover 1 with the corresponding recess 5 of the helmet 2; and force-fitting other portion of the cover 1 over the helmet 2 with the engaged point used as a reference point while positioning the cover 1 at the wind splitting recesses 5 and 12 on the front and opposite sides of the cover 1. Thus, the cover 1 is closely fitted on the helmet 2 by virtue of its elastic deformation. The cover 1 thus fitted on the helmet 2 will not unexpectedly come off.

Since the cover 1, as a whole, has flexibility and elasticity as mentioned above, the cover 1 is, of course, removable from the helmet 2 with extreme ease and rapidity by lifting right and left forward portions of the cover 1. Further, the rib effect developed by the wind splitting recesses 12 of the cover 1 enables repeated fitting and removal of the cover 1.

Thus, even if it begins to rain during the use of the helmet 2 without the cover 1, the cover 1 can be rapidly fitted on the helmet 2 and removed from therefrom after the rain stops. In this way the cover 1 can be used repeatedly.

Since the cover 1 according to the present invention is made of a transparent resin material (including translucent material) as mentioned above, it does not shade the painting (including patterns, characters such as letters and numbers, and ground color) of the helmet 2. Thus, the helmet 2 as fitted with the cover 1 presents the same appearance as without cover 2.

If the cover 1 is differently painted than the helmet 2, the design of the helmet 2 is changed. This enables the user or anyone else to see at a glance whether the cover 1 is fitted or not on the helmet 2, and further, to impart the helmet 2 with any desired design.

Figure 4:
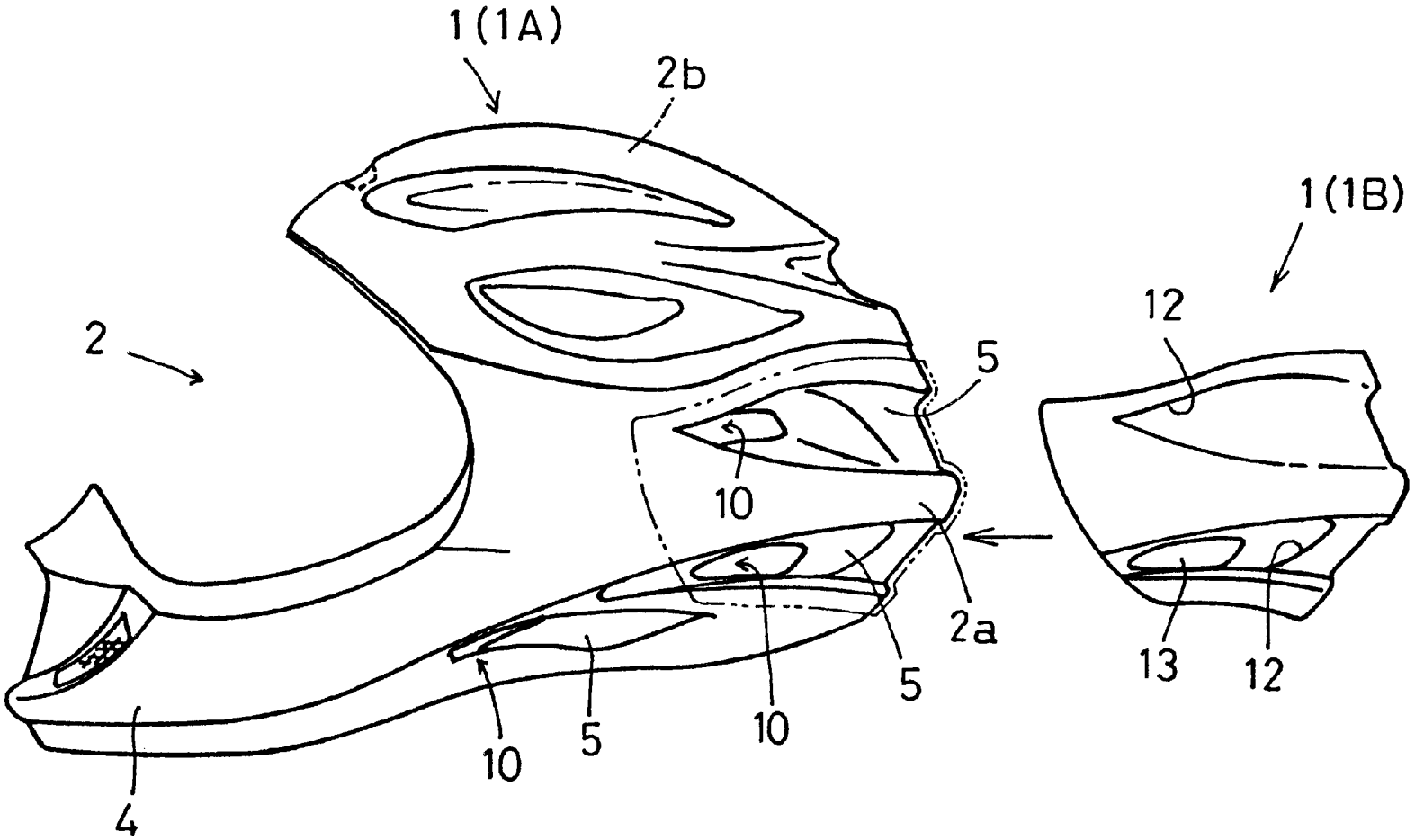
FIG. 4 is a side elevational view showing a helmet cover including the helmet cover shown in FIG. 1 as covering a top portion of the helmet and a separate helmet cover to be fitted on a rear portion of the helmet.

The cover 1 may be formed to cover other region than the top region 2*b* of the helmet 2. As shown in FIG. 4, for example, the cover 1 may be formed as a cover 1B for covering 1a rear region other than the top region 2*b* (for example, for covering the wind control region 2*a*) separately from a cover 1A for covering the top region 2*b*.

Where a plurality of covers 1A and 1B having different shapes are used in combination, the covers 1A and 1B may cover entire surface of any helmet 2 having any complicated shape. Thus, a helmet with all its through-holes 10 closed with such covers is provided.

The cover 1B for covering the rear region is formed with a pair of right and left inwardly protruding portions 13 corresponding to the through-holes 10 defined at lower right and left positions in the wind control region 2*a* of the helmet 2. These protruding portions 13 are biased elastically toward each other thereby maintaining the fitting condition of the cover 1B on the helmet 2.

Figure 5:
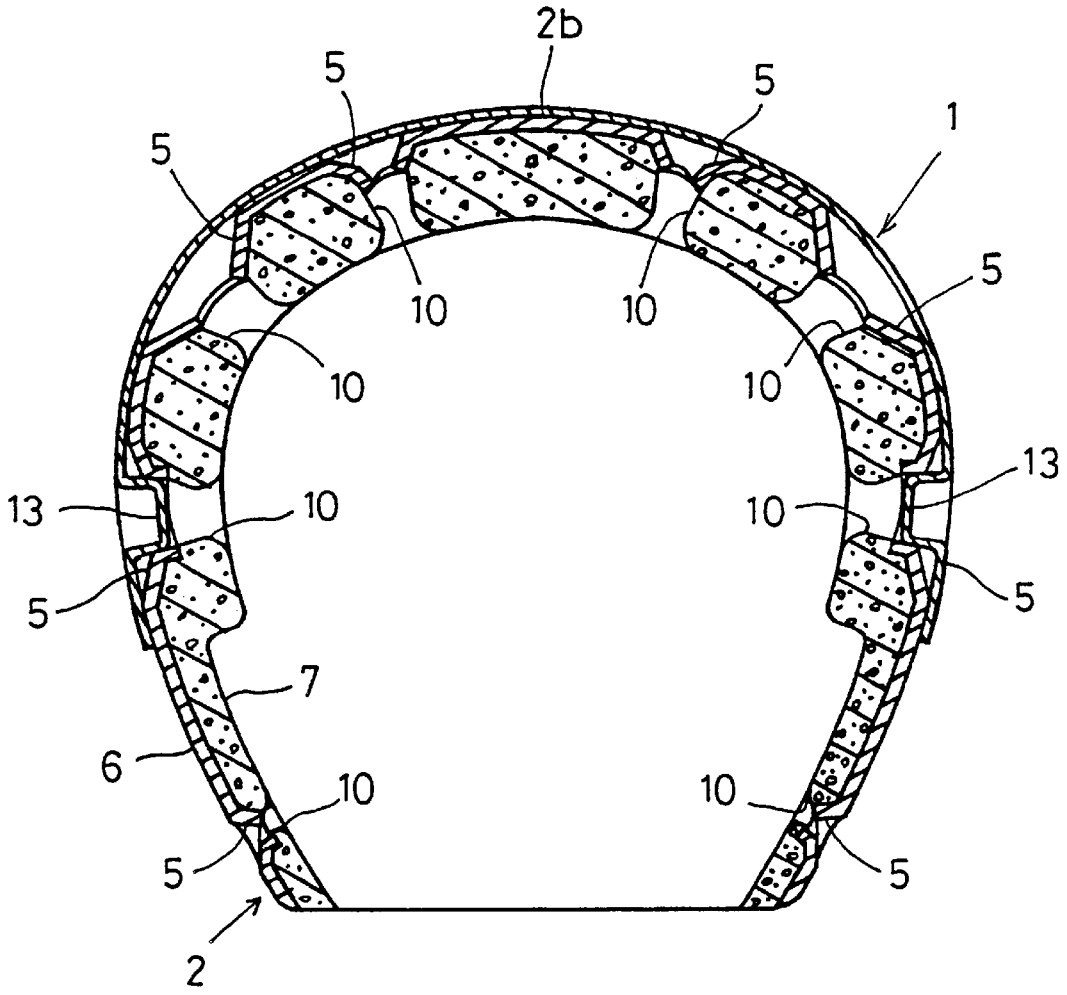
FIG. 5 is a sectional view, corresponding to FIG. 3, of a helmet cover as fitted on a helmet, the helmet cover having no wind splitting recess unlike the helmet cover shown in FIG. 1.

As shown in FIG. 5, the cover 1A for covering the top region, for instance, may be formed to have a spherical outer surface between the wind splitting recesses 12 corresponding to the wind splitting recesses 5 of the helmet 2 located in the opposite side portions thereof.

Figure 6:
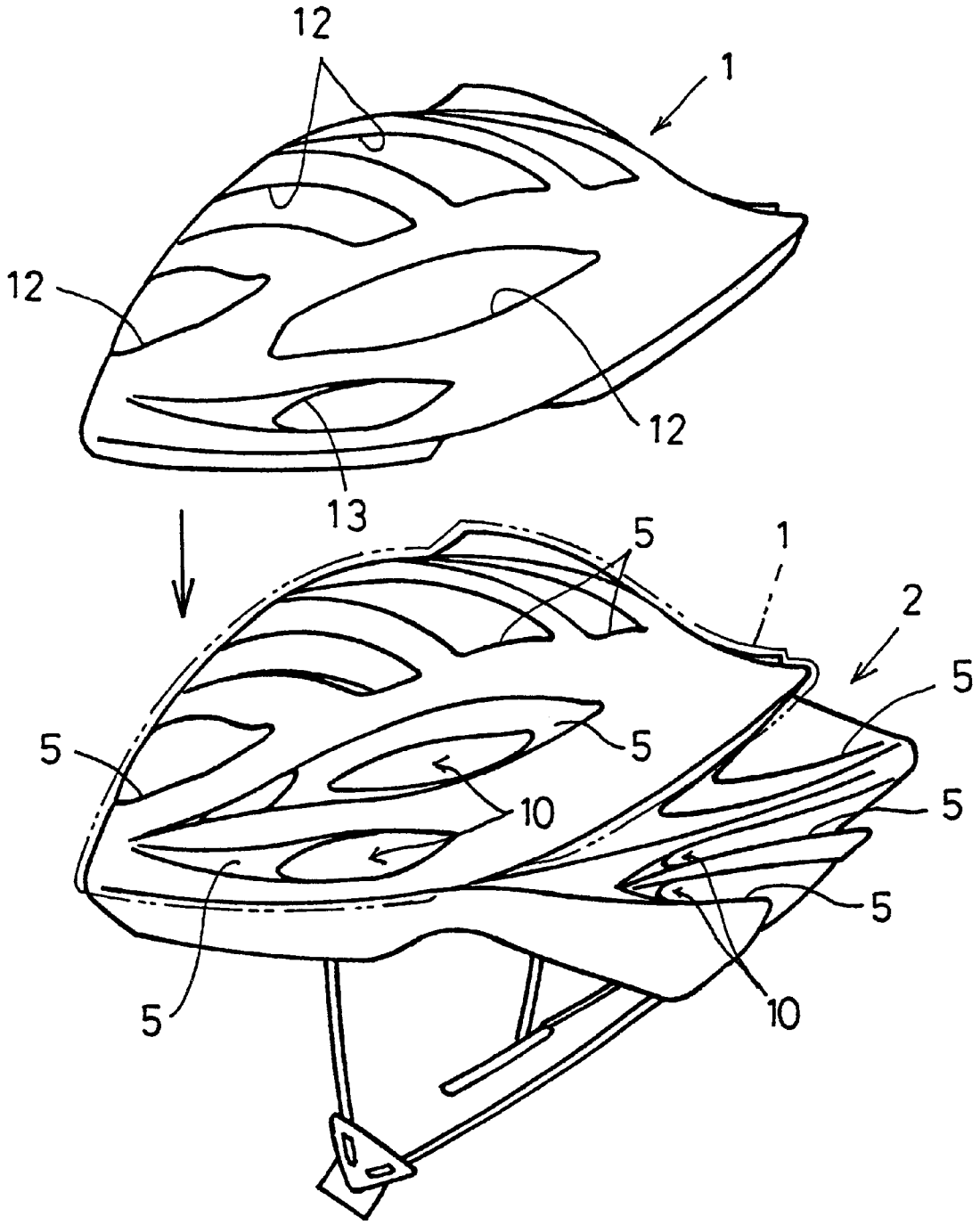
FIG. 6 is a side elevational view showing another embodiment of a helmet cover for use with a helmet of a different type.

The helmet 2 may have any shape and structure, for example, a full-face type shape, a jet plane-like shape and the like, as shown in FIG. 6, without any limitation. The shape of the cover 1 or structure for maintaining the fitting condition may be changed to match the shape and structure of the helmet 2 as required.

The present invention may include, as well as the foregoing embodiments, various variations in detail structure, shape, material, manufacturing process, application of helmet and the like, which are adaptable for conditions of the practice of the invention.

The cover 1 is not necessarily prepared to have a shape matching the contour of the helmet 2; for example, the cover 1 may be prepared as a primary product having a configuration of, for example, a hollow hemisphere, flexible pouch or sheet, or the like having a size a little larger than the helmet 2 and being made of a resin material which has a property to be contracted or deformed into a predetermined three-dimensional shape by heating and cooling.

Such primary product is put on the helmet 2, heated with hot water or hot air, and then subjected to natural cooling or rapid cooling, if necessary, with water or the like. Thus, the primary product of the cover 1 is deformed or shrunk into a predetermined three-dimensional shape so as to be conformably fitted over the helmet 2 in a face contact fashion.

This feature enhances the close fitting property of the cover 1 on the helmet 2 and, further, provides the cover 1 with a wider applicability to various types of helmets.

Further, the cover 1 having wind splitting recesses 12 can be readily formed using a mold (for vacuum forming process) which has been used to mold the helmet 2 having the wind splitting recesses 5, thereby considerably reducing production cost.

As has been described, the helmet cover according to the present invention can be fitted over various types of helmets for, for example, bicyclists when required. When fitted on a helmet having through-holes at predetermined locations, the helmet cover can close the through-holes for providing protection against cold and rain easily and rapidly.

By forming wind splitting recesses in the helmet cover which match the wind splitting recesses formed at predetermined locations in the helmet a rib effect is developed by the cover, while the helmet cover fitted on the helmet does not add a substantial increase to the reduced air resistance of the helmet. Further, if each wind splitting recess is formed with an inwardly protruding portion adapted to protrude into a corresponding through-hole, the helmet cover can be fitted on and removed from the helmet easily and rapidly. Such easy and rapid fitting and removal can be made repeatedly as desired.

The helmet cover formed of a resin material can be made very thin and can be fitted over the helmet in a face contact fashion. Thus, the tendency to reduce the weight and air resistance of helmets will be not hindered by the helmet cover.

If the helmet cover is formed of a transparent resin material, the helmet fitted with the helmet cover presents the same appearance as without the helmet cover.

Unlike the transparent cover, if the helmet cover is painted, the fitting of the cover on the helmet can be perceived clearly, or the design of the helmet as a whole can be changed.

While the presently preferred embodiments of the present invention have been described in detail, as will be apparent with those familiar with the art, various variations and modifications can be made in embodiments without departing from the scope of the invention defined by the following claims.

What is claimed is:

1. A removable helmet cover for use with a helmet having a wind splitting recess running along lower lateral parts of the helmet, respectively, each lower lateral wind splitting recess having a through-hole therein, the removable helmet cover comprising a configuration fittable over the helmet, and at least two engaging members positioned on an interior surface of the removable cover, whereby, when the removable cover is fitted on the helmet, the at least two engaging members each fixedly engage one of the through-holes to thereby hold the removable helmet cover on an exterior layer of the helmet, wherein the removable helmet cover is formed of elastic resin material.

2. The removable helmet cover as set forth in claim 1, wherein the resin material forming the helmet cover is transparent.

3. The removable helmet cover as set forth in claim 1, which has a decorative appearance different than the helmet.

4. The removable helmet cover as set forth in claim 1, wherein the configuration of the removable helmet cover to be fitted over the helmet is for fitting over only a top region of the helmet.

5. The removable helmet cover according to claim 1, wherein the helmet further includes a through-hole positioned in a front surface thereof, and the removable cover further includes an additional engaging member positioned on the interior surface of the removable cover, whereby, when the removable cover is fitted on the helmet, the additional engaging member engages the through-hole positioned in the front surface of the helmet to further ensure the removable helmet cover is held on the exterior layer of the helmet.

6. The removable helmet cover according to claim 1, wherein the helmet further includes a wind splitting recess positioned along a rear surface of the helmet, and the cover further includes an additional engaging member positioned on the interior surface of the removable cover, whereby, when the removable cover is fitted on the helmet, the additional engaging member engages the wind splitting recess positioned along the rear surface to further ensure the removable helmet cover is held on the exterior layer of the helmet.

7. The removable helmet cover according to claim 1, further comprising another removable cover for covering a rear lower region of the helmet.

8. The removable helmet cover according to claim 7, wherein the helmet further includes a through-hole formed in rear lower lateral portions of the helmet, respectively, and the another removable cover includes a plurality of engaging members formed on an interior surface thereof, whereby, when the another removable cover engages the helmet, each respective engaging member of the plurality of engaging members engages with a corresponding through-hole formed in the rear lower lateral portions of the helmet.

* * * * *